US007824120B1

(12) United States Patent
Kasper et al.

(10) Patent No.: US 7,824,120 B1
(45) Date of Patent: Nov. 2, 2010

(54) HAND HELD CARPET SPOT CLEANER

(75) Inventors: Gary A. Kasper, Grand Rapids, MI (US); Herbert J. Vanderbilt, Lowell, MI (US); Jose Carlito Santiago, Grand Rapids, MI (US)

(73) Assignee: BISSELL Homecare, Inc., Grand Rapids, MI (US)

( * ) Notice: Subject to any disclaimer, the term of this patent is extended or adjusted under 35 U.S.C. 154(b) by 1027 days.

(21) Appl. No.: 11/558,494

(22) Filed: Nov. 10, 2006

(51) Int. Cl.
*A46B 11/00* (2006.01)

(52) U.S. Cl. ..... 401/39; 401/37; 401/184; 401/186

(58) Field of Classification Search ..... 401/37, 401/39, 183–186; 222/464.3, 464.4, 464.6, 222/481.5; 132/148, 112–116
See application file for complete search history.

(56) References Cited

U.S. PATENT DOCUMENTS

| | | | | |
|---|---|---|---|---|
| 1,989,201 | A | 1/1935 | Kurtz et al. | |
| 2,090,050 | A | 8/1937 | Jackson | |
| 2,260,100 | A * | 10/1941 | Deitrich et al. | 401/272 |
| 2,680,010 | A | 6/1954 | Dubay | |
| 2,887,709 | A | 5/1959 | Carolonza | |
| 3,148,522 | A | 9/1964 | Court | |
| 3,672,533 | A * | 6/1972 | McKean | 220/745 |
| 4,134,697 | A * | 1/1979 | Sparr, Sr. | 401/276 |
| 5,657,909 | A * | 8/1997 | Barriac | 222/382 |
| 5,971,645 | A | 10/1999 | Fukushima | |
| 6,227,740 | B1 * | 5/2001 | Stear et al. | 401/188 R |

FOREIGN PATENT DOCUMENTS

| | | | |
|---|---|---|---|
| WO | 2005009198 | A1 | 2/2005 |
| WO | 2006005936 | A1 | 1/2006 |

* cited by examiner

*Primary Examiner*—David J Walczak
(74) *Attorney, Agent, or Firm*—McGarry Bair PC

(57) ABSTRACT

A hand held cleaning apparatus for cleaning carpets and other surfaces comprises a housing and a solution reservoir mounted to the housing for storing and dispensing a cleaning composition onto the surface to be cleaned. The solution reservoir further comprises a dispenser assembly including a flexible vent tube that is weighted to consistently orient a free end of the vent tube away from the cleaning composition.

21 Claims, 7 Drawing Sheets

HAND HELD CARPET SPOT CLEANER

BACKGROUND OF THE INVENTION

1. Field of the Invention

This invention relates to a hand held surface spot cleaning apparatus. In one aspect, the invention relates to a hand held surface cleaning assembly comprising a cleaning pad mounted to a housing designed so that a user can easily and comfortably apply downward pressure on the cleaning pad against the surface to be cleaned. In another aspect, the invention relates to a handheld surface cleaning assembly comprising a solution container with a manual squeeze dispenser for applying cleaning solution onto the surface to be cleaned. In yet another aspect, the invention relates to a handheld surface cleaning assembly comprising a plurality of scrubbing surfaces mounted to a cleaning solution container that includes a dispensing orifice to dispense liquid from the cleaning solution container.

2. Description of the Related Art

Upright extractors and canister extractors are known for cleaning carpets and upholstery. However, these devices are generally bulky and inconvenient to use for cleaning relatively small spots in the home and are awkward to use in areas outside the home, such as in automobiles. A small, portable handheld device is preferred for cleaning small spots both in the home and in environments outside the home.

Hand held composition dispensers are known. PCT patent application WO2005/009198 discloses a shoe polishing applicator having a squeezable reservoir containing a cleaner/polishing solution, and a block mounting the reservoir with a flat bottom side. The dispensing mechanism has a valve member with a slit diaphragm to control the flow of solution from the dispenser.

U.S. Pat. No. 5,971,645 to Fukushima discloses a hand held container for detergent composition and a dispenser. The dispenser comprises a squeezable reservoir, a filter screen, a removable cap and a dispensing member that includes a flow-restricted orifice and an applicator for applying the cleaning fluid to a fabric to be cleaned.

SUMMARY OF THE INVENTION

According to the invention, a handheld surface cleaning apparatus comprises a housing, a cleaning solution reservoir assembly for storing a predetermined amount of a cleaning fluid mounted to the housing, a solution dispenser assembly associated with the cleaning solution reservoir for delivering the cleaning fluid to a surface to be cleaned and including a vent tube having a length within the solution dispenser assembly and an end portion adapted to extend into an air space within the solution reservoir when the solution reservoir is less than completely filled with the cleaning fluid. The vent tube is configured so that at least the vent tube end portion extends into the air space regardless of the orientation of the housing with respect to the horizontal.

In one embodiment, the vent tube has a weight positioned along the length thereof, preferably in a central portion thereof, to maintain the end portion of the vent tube oriented upwardly. Further, a float mounted to the end portion of the vent tube to maintain the end portion thereof above the cleaning solution level in the reservoir. Preferably, the float is made of closed cell foam and is shaped to orient the vent tube end portion away from a lower portion of the solution reservoir. The weight can be positioned in different locations along the length of the vent tube so long as the end portion of the vent tube is above the surface of the cleaning solution in the reservoir. For example, the weight can be combined with the float at the end of the float tube so long as the end portion of the vent tube remains above the surface of the cleaning solution level in the reservoir.

In a preferred embodiment, a cleaning fluid is present in the cleaning solution reservoir and the cleaning fluid includes a peroxide compound. Preferably, the peroxide compound is hydrogen peroxide in an amount up to 10% by weight.

In another embodiment of the invention, a comb assembly is mounted to the housing. The comb assembly extends from a rear surface of the housing and comprises a plurality of relatively stiff bristles that extend in a direction generally perpendicular to the rear surface of the housing.

In a further embodiment of the invention, a brush assembly is mounted to the housing in an orientation generally transverse to the comb assembly. Typically, the brush assembly comprises a plurality of relatively flexible bristles that extend generally perpendicularly from the bottom surface of the housing.

In yet another embodiment of the invention, the housing and cleaning solution reservoir are configured to comfortably fit the palm of a user's hand for manipulation of the comb assembly and the brush assembly as well as dispensing the cleaning fluid from the cleaning fluid reservoir.

In a preferred embodiment of the invention, the dispensing assembly comprises an outlet opening in the bottom surface of the housing within the brush assembly.

Further according to the invention, a handheld surface cleaning apparatus comprises a housing, a solution reservoir assembly for storing a predetermined amount of a cleaning fluid mounted to the housing, a solution dispenser assembly associated with the solution reservoir for delivering the cleaning fluid to a surface to be cleaned and a comb assembly mounted to the housing.

In accordance with one embodiment of this invention, a brush assembly mounted to the housing in an orientation perpendicular to the comb assembly.

In a preferred embodiment of the invention, the dispensing assembly comprises an outlet opening in the bottom surface of the housing within the brush assembly. Further, the housing and cleaning solution reservoir are configured to comfortably fit the palm of a user's hand for manipulation of the brush assembly as well as dispensing the cleaning fluid from the cleaning fluid reservoir through the dispensing assembly outlet opening.

DESCRIPTION OF THE PREFERRED EMBODIMENTS

Figure 1:
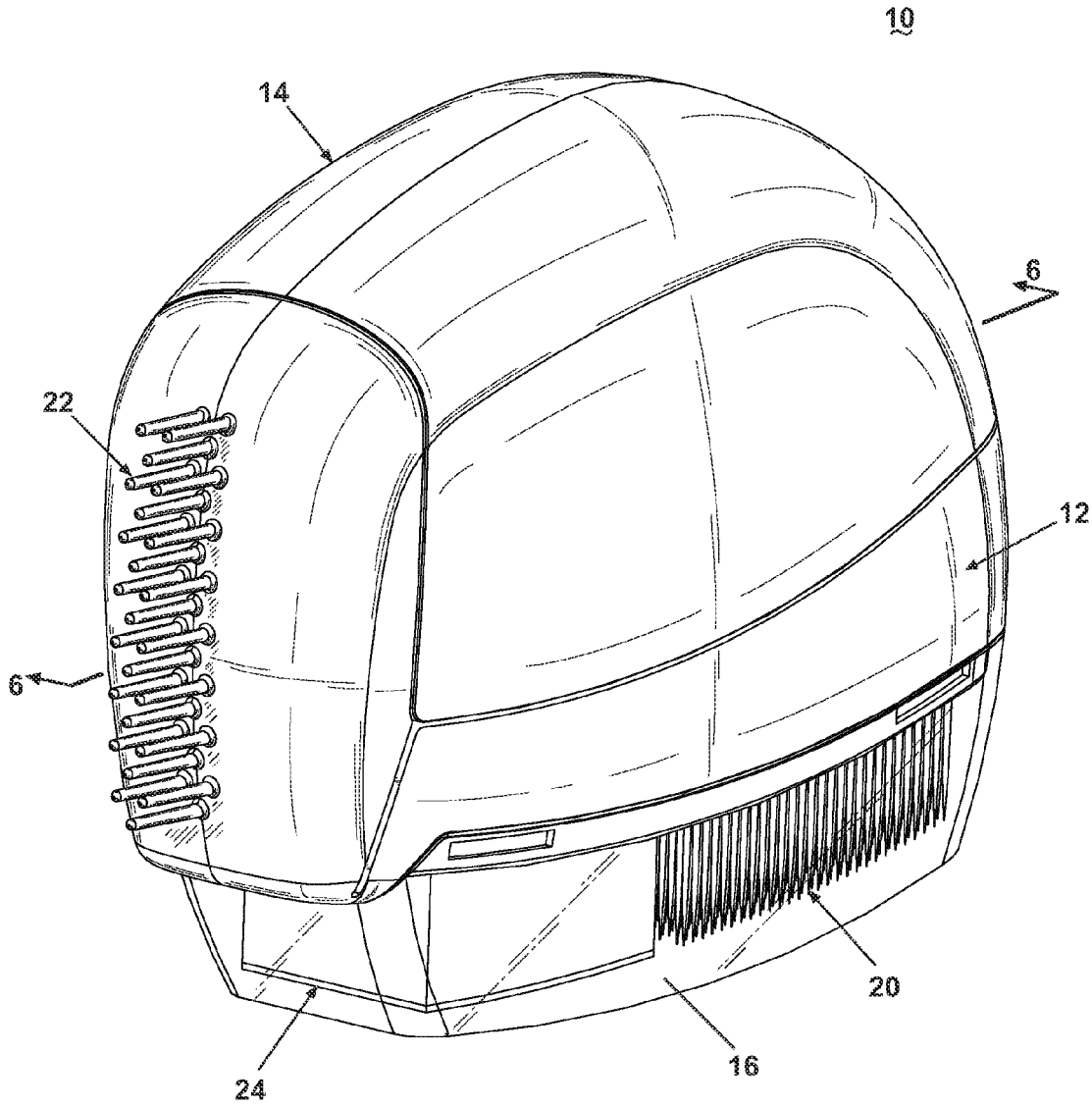
FIG. 1 is a rear perspective view of a hand held spot cleaner according to the invention.
Figure 2:
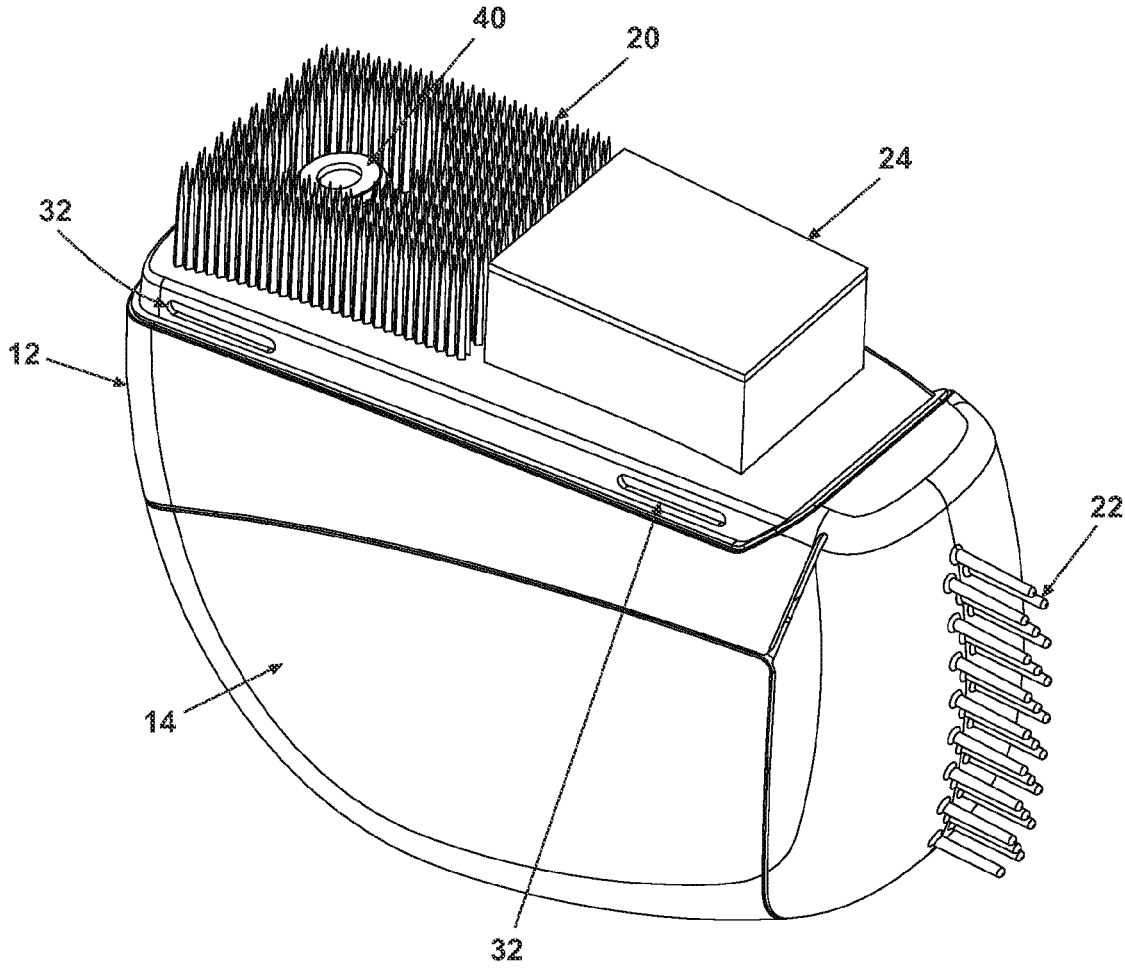
FIG. 2 is a bottom perspective view of the spot cleaner of FIG. 1.
Figure 3:
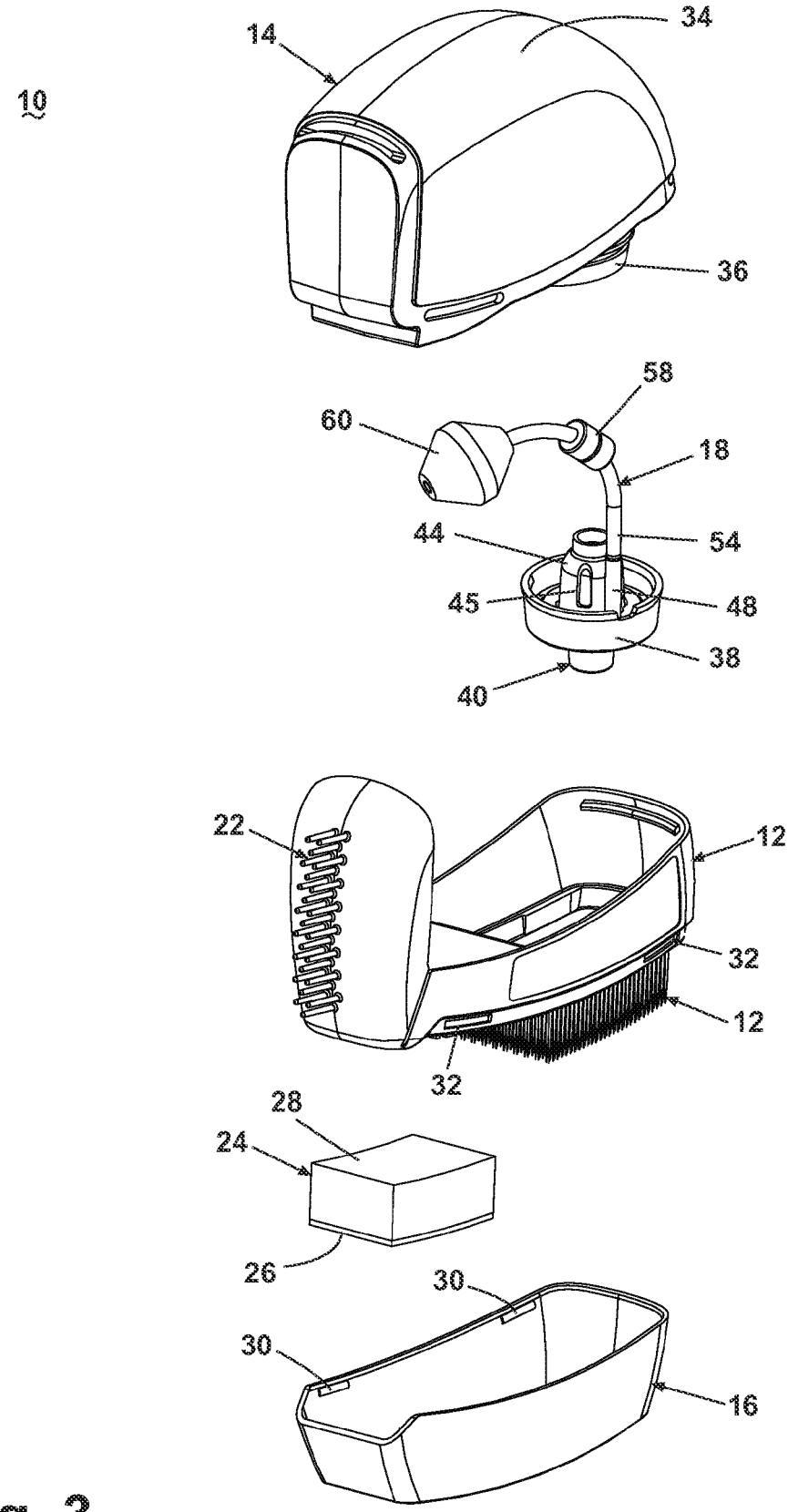
FIG. 3 is an exploded view of the spot cleaner of FIG. 1 with a cover removed.
Figure 4:
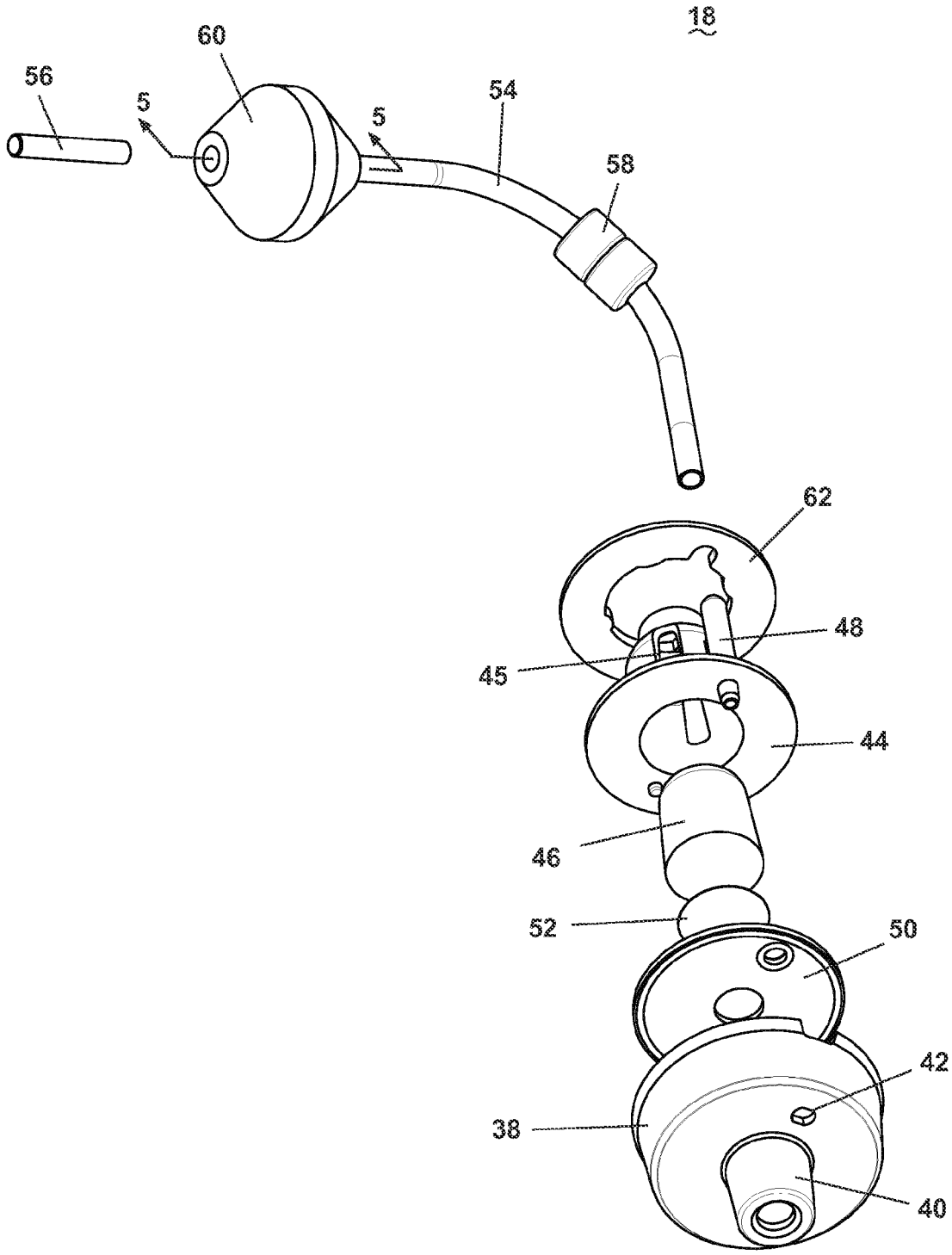
FIG. 4 is an exploded view of a dispenser assembly of FIG. 2.
Figure 5:
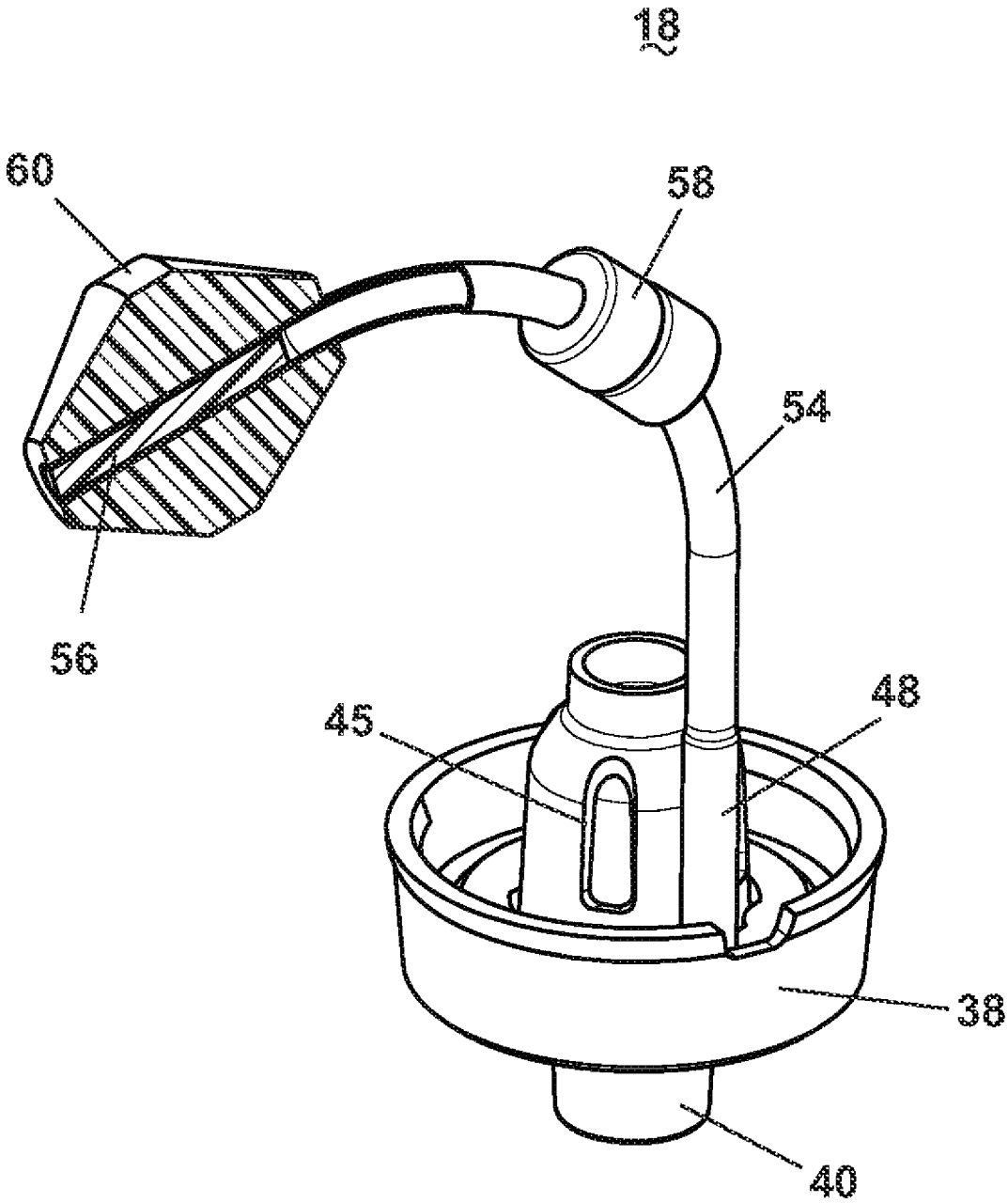
FIG. 5 is a partial cross section of a float assembly through line 5-5 of FIG. 4.

Referring to the drawings, and particularly FIGS. 1-3, a hand held spot cleaner assembly 10 comprises a cleaner housing 12, a solution reservoir assembly 14, and a cover 16. The hand held spot cleaner 10 is dimensioned so that the solution reservoir assembly 14 comfortably fits in the palm of either hand of a user and is sized to fit a wide range of hand sizes. The cleaner housing 12 is a generally hollow bodied L shaped structure wherein a bottom surface has a plurality of perpendicularly extending flexible bristles that form a brush assembly 20. A rear surface has a comb assembly 22 comprised of a plurality of stiff bristles extending in a direction generally perpendicular to the rear surface of the cleaner housing and parallel to the bottom surface thereof. An orifice (not shown) is formed in the bottom surface within and surrounded by the brush assembly 20 and is located in a forward portion of the cleaner housing 12. "Forward" as used herein signifies the end of the housing 12 opposite the comb assembly 22. In the preferred embodiment, the bottom surface of the housing is formed in a slight arc; however, the bottom surface can also be flat or formed into a series of flat surfaces.

A cleaning pad assembly 24 is affixed to the bottom surface directly behind the brush assembly 20. The cleaning pad assembly 24 further comprises a first laminate structure 26 bonded to a foam pad 28 and is configured such that the depth of the cleaning pad assembly 24 is roughly equal to the depth of the brush assembly 20. In the preferred embodiment, the first laminate structure 26 contacts the surface to be cleaned and is denser than the foam pad 28 to which it is bonded. The foam pad 28 provides flexibility and absorbency for the cleaning pad assembly 24 while the more dense first laminate structure 26 provides good wear resistance.

The cover 16 is removably secured to the bottom surface of the cleaner housing 12 by a plurality of interlocking ribs 30 and recesses 32. In the preferred embodiment, the cover 16 has at least four ribs 30 extending inwardly from side walls that removably engage with corresponding recesses 32 in the cleaner housing 12. A plug (not shown) extends upwardly from a bottom inside surface of the cover 16 to engage a dispensing orifice 40 in the dispenser assembly 18. Preferably, the cover 16 has gaps around the perimeter of its interface with the housing 12 or, alternatively, can have a plurality of holes formed in the sidewalls therein to permit air to flow through the cover 16. The cover 16 is preferably made of a transparent material for visibility to the brush assembly 20 and cleaning pad assembly 24 when the cover 16 is attached. An outer bottom surface of the cover 16 is generally flat and dimensioned to provides a stable base on which the hand held spot cleaner 10 can rest.

Referring to FIGS. 2-5, the solution reservoir assembly 14 comprises a solution container 34 and the dispenser assembly 18. The solution container 34 can be made of a plastic blow molded container with a single orifice forming a neck 36 as is commonly known in the liquid cleaning industry. The dispenser assembly 18 further comprises a cap 38 comprising a dispensing orifice 40 and an aperture 42. A foaming chamber 44 comprises a foamer 46 and a vent conduit 48. The foaming chamber 44 is fluidly sealed by a first seal 50 located between the cap 38 and the foaming chamber 44. The foamer 46 can be an open cell foam material that that mixes air with solution passing therethrough to create foam as is commonly known in the art. Preferably, an additional absorbent cloth 52 can be placed between the foaming chamber 44 and the first seal 50 and its function will be described in more detail hereinafter. A length of very flexible vent tube 54 is slid over the vent conduit 48 in a sealing fashion on one end and a sintered valve 56 is inserted into the other end of the vent tube 54. The sintered valve 56 is porous so that air can pass therethrough while inhibiting the flow of liquid therethrough.

At least one generally torroidal tube weight 58 is slid over the outer periphery of the vent tube 54 and is positioned generally mid-way between the ends of the vent tube 54. Desirably, the tube weight 58 remains stationary at the midpoint of the vent tube 50 and the path within the vent tube 50 remains unrestricted. The tube weight 58 can be of any shape and composed of any material; however, stainless steel or high density plastic is preferred.

A closed cell float 60 is fixed in a stationary manner about the outer periphery of the vent tube 54 at the sintered valve 56. In a preferred embodiment, the float 60 is formed in the shape of a pair of inverted cones with the base of the cones joined. The tube weight 58 should weigh more than the vent tube 54; however, the weight 58 should not exceed the buoyancy of the float 60.

The solution reservoir assembly 14 is assembled by placing a second seal 62 over the float 60 and inserting the float 60, vent tube 54, and foaming chamber 44 into the solution container 34 orifice formed by the neck 36 until the foaming chamber 44 and seal 62 are seated on the neck 36. The first seal 50 is placed over the exposed surface of the foaming chamber 44 so that the end of the vent conduit 48 remains clear. Optionally, the absorbent cloth 52 is placed between the foaming chamber 44 and the second seal. The cap 38 is then placed over the foaming chamber 44 and first seal 50 so that the vent conduit 48 protrudes through the aperture 42 in the cap 38. The cap 38 is then press fit over the neck 36 to create a leak resistant closure.

The solution reservoir assembly 14 preferably stores and dispenses an aqueous cleaning composition and a predetermined head space for air. In the preferred embodiment, the solution reservoir assembly 14 is prefilled; however, the dispenser assembly can be modified to be refilled by the user. While the cleaning composition can be any suitable aqueous cleaning composition, the cleaning composition preferably comprises a peroxygen compound for superior cleaning of stains caused by red wine, pet stains, food stains, fruit juice, coffee, tea, chocolate, ink, motor oil, and others. The solution reservoir assembly 14 as described is particularly well suited for storing peroxygen compounds due to the vented dispenser assembly 18 as will be described further.

Figure 6A:
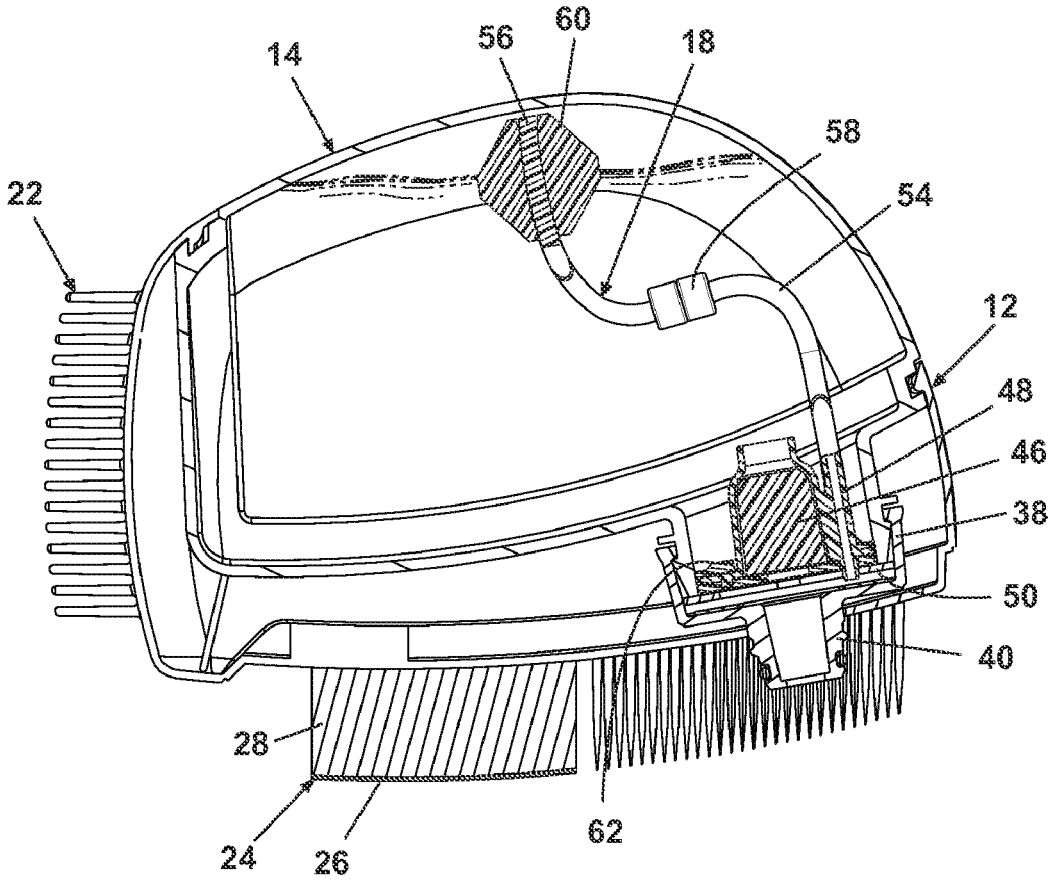
FIG. 6A is a cross section of the hand held spot cleaner in a horizontal position through line 6-6 of FIG. 1.
Figure 6B:
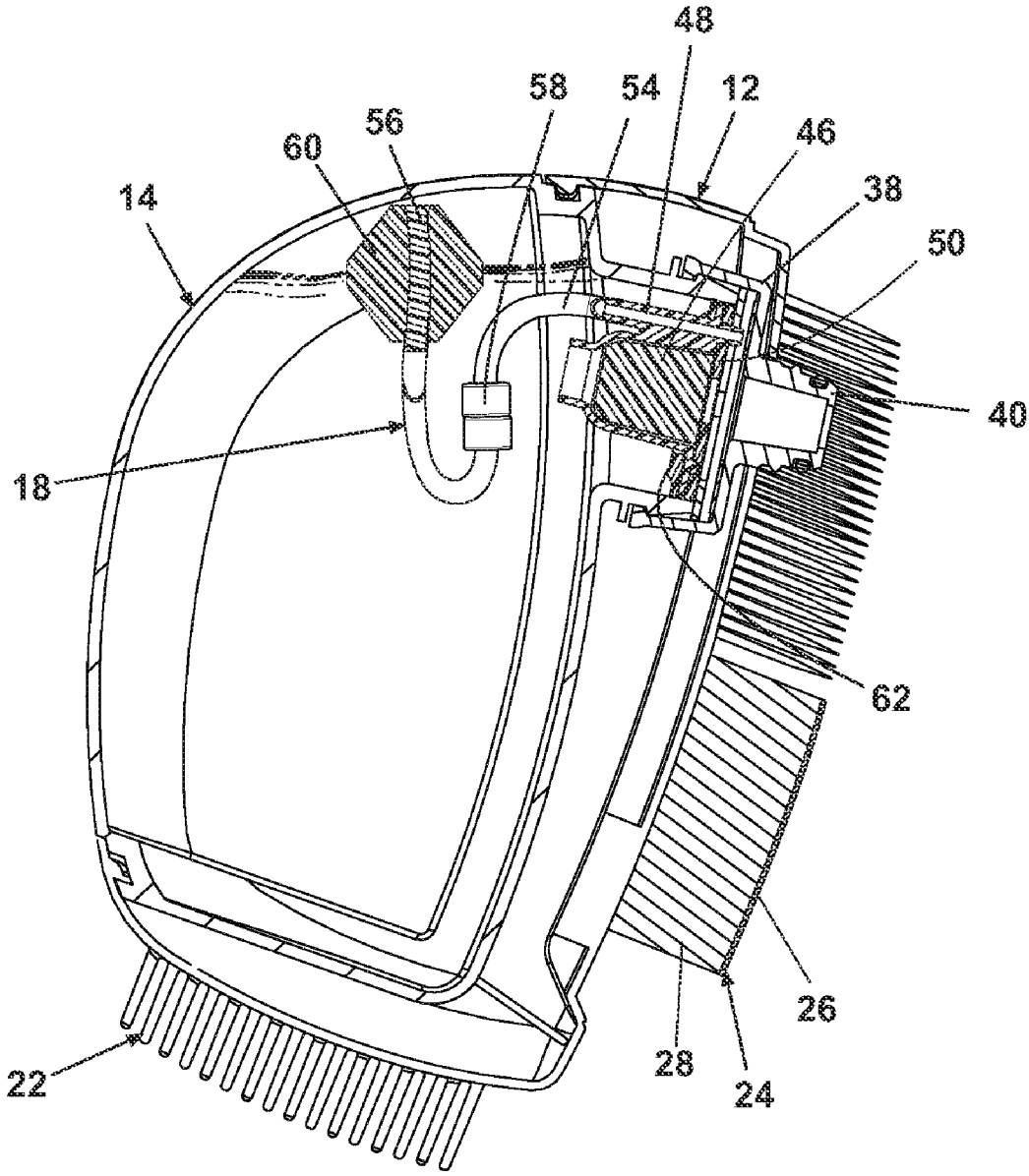
FIG. 6B is a cross section of the hand held spot cleaner in an inclined position through line 6-6 of FIG. 1.

Referring to FIGS. 6A and 6B, in operation, the hand held spot cleaner 10 is readied for use by picking the cleaner 10 up by the solution reservoir assembly 14 and removing the cover 16. In the orientation depicted in 6A, the cleaning composition level is generally parallel to the bottom surface of the cleaner housing 12 and the float 60 keeps the vent tube 54 in a generally upright position. To dispense the cleaning composition, the user squeezes the solution reservoir assembly 14 which creates a head pressure on the cleaning composition, forcing the cleaning composition through the foaming chamber apertures 45 in the foaming chamber 44, through the foamer 46, and out the dispensing orifice 40 in a foam form over the surface to be cleaned. When sufficient composition has been dispensed, the user releases the pressure on the solution reservoir assembly 14. Air re-enters the reservoir assembly 14 through the exposed end of the vent conduit 48, passing through the vent tube 54, through the sintered valve 56 and into the head space of the reservoir assembly 14. The sintered valve 56 is particularly important because it passes air to flow therethrough, but restricts the flow of liquid and thereby prevents the spot cleaner 10 from leaking when not in use. Furthermore, the dispenser assembly 18 vent is particularly useful when the cleaning solution is a peroxygen compound because the vent assembly will vent excess pressure formed in the head space in the event any or all of the peroxygen compound reacts with potential contamination inside the solution container 34, or as a result of normal decomposition of hydrogen peroxide into water and oxygen as a result of elevated temperature storage of the spot cleaner 10 or as a result of changes in atmospheric pressure and thus preventing damage to the cleaner 10 from excessive internal pressure. In a preferred embodiment of the invention, the cleaning composition has from 1-10% by weight of hydrogen peroxide.

The shape of the float 60 and the location of the tube weights 58 on the vent tube 54 are advantageous as the user varies the orientation of the spot cleaner 10 during use. As the spot cleaner 10 is tilted, the tube weight 58 will pull the vent tube 54 down under force of gravity and the shape of the float 60 will always keep the sintered valve 56 above or out of the liquid cleaning composition. The tube weights 58 function to keep the sintered valve above the level of liquid in the solution container 34, regardless of the orientation of the spot cleaner 10. Otherwise, the vent tube 54 may float to the top of the liquid composition and force the sintered valve 56 into the composition and impede operation and may cause leaking.

An optional precaution against leaking is provided by the location of the absorbent pad 52 at the exit of the foaming chamber 44. In some cases, small amounts of liquid may condense inside the vent tube 54 or may migrate past the sintered valve 56 and drip through the foamer 46. The absorbent pad 52 absorbs the extraneous liquid and prevents leaking.

When sufficient composition has been dispensed, the composition can soak into the surface in order for the composition to react with the stain. In addition, the user can engage the brush assembly 20 or the cleaning pad 24 to provide manual agitation and the work the composition deeper into the surface to be cleaned. Optionally, excess composition can be removed with an absorbent cloth or with a commonly known extraction cleaning machine. Otherwise, the composition can be air dried. The comb assembly 22 can be used as a grooming tool after the spot has dried to revitalize the carpet fibers.

The hand held spot cleaner described is not limited to cleaning soft surfaces, such as carpets, upholstery, and fabrics. The hand held spot cleaner can also be employed to clean hard surfaces, such as tile and linoleum. The type of cleaning liquid stored in the liquid container assembly can be selected based on the type of surface to be cleaned. Further, the cleaning head can comprise an agitator suitable for the type of surface to be cleaned. Examples of agitators include, but are not limited to, brushes (as described above), sponges, scrubbing pads, dusting pads, and ultrasonic vibrating cleaning members.

While the invention has been specifically described in connection with certain specific embodiments thereof, it is to be understood by way of illustration and not of limitation, and the scope of the appended claims be construed as broadly as the prior art would permit. Reasonable variation and combinations are possible within the foregoing disclosure without departing from the spirit of the invention, which is defined by the appended claims.

We claim:

1. A handheld surface cleaning apparatus comprising:

a housing;

a cleaning solution reservoir assembly mounted to the housing and including a solution container for storing a predetermined amount of a cleaning fluid and a solution dispenser assembly connected to the solution container through an orifice in the solution container for delivering the cleaning fluid in the solution container to a surface to be cleaned;

the solution dispenser assembly includes a vent tube having a length within the solution dispenser assembly and an end portion adapted to extend into an air space within the solution reservoir when the solution reservoir is less than completely filled with the cleaning fluid;

a float mounted to the end portion of the vent tube;

wherein the vent tube is configured so that at least the vent tube end portion extends into the air space regardless of the orientation of the housing with respect to the horizontal; and wherein the vent tube has a weight mounted to a central portion of the length thereof and spaced from the float.

2. The handheld surface cleaning apparatus according to claim 1, wherein the float is made of a closed cell foam.

3. The handheld surface cleaning apparatus according to claim 2 wherein the float is shaped to orient the vent tube end portion away from a lower portion of the solution reservoir.

4. The handheld surface cleaning apparatus according to claim 1 and further comprising a comb assembly mounted to the housing.

5. The handheld surface cleaning apparatus according to claim 4 wherein the a comb assembly extends from a rear surface of the housing and comprises a plurality of relatively stiff bristles that extend in a direction generally perpendicular to the rear surface of the housing.

6. The handheld surface cleaning apparatus according to claim 5 and further comprising a brush assembly mounted to the housing in an orientation generally transverse to the comb assembly.

7. The handheld surface cleaning apparatus according to claim 6 wherein the brush assembly comprises a plurality of relatively flexible bristles that extend generally perpendicularly from a bottom surface of the housing.

8. The handheld surface cleaning apparatus according to claim 7 wherein the solution container is configured to comfortably fit the palm of a user's hand for manipulation of the comb assembly and the brush assembly as well as dispensing the cleaning fluid from the cleaning fluid reservoir.

9. The handheld surface cleaning apparatus according to claim 1 wherein the housing and cleaning solution reservoir are configured to comfortably fit the palm of a user's hand.

10. The handheld surface cleaning apparatus according to claim 1 and further comprising a brush assembly mounted to a bottom surface of the housing.

11. The handheld surface cleaning apparatus according to claim 10 wherein the brush assembly comprises a plurality of relatively flexible bristles that extend generally perpendicularly from the bottom surface of the housing.

12. The handheld surface cleaning apparatus according to claim 11 wherein the dispensing assembly comprises an outlet opening in the bottom surface of the housing within the brush assembly.

13. The handheld surface cleaning apparatus according to claim 12 wherein the housing and cleaning solution reservoir are configured to comfortably fit the palm of a user's hand for manipulation of the brush assembly as well as dispensing the cleaning fluid from the cleaning fluid reservoir through the dispensing assembly outlet opening.

14. A kit for cleaning surfaces comprising:

the handheld surface cleaning apparatus according to claim 1, and a cleaning fluid in the cleaning solution reservoir wherein the cleaning fluid includes a peroxide compound.

15. A kit for preparing a cleaning solution according to claim 14 wherein the peroxide compound is hydrogen peroxide.

16. A kit for preparing a cleaning solution according to claim 15 wherein the hydrogen peroxide is present in the cleaning fluid in an amount up to 10% by weight.

17. The handheld surface cleaning apparatus according to claim 1 wherein the housing has a bottom surface with an aperture therein, and the solution dispenser assembly has an outlet opening in the aperture.

18. The handheld surface cleaning apparatus according to claim 17 wherein the outlet opening further has a foamer for foaming the cleaning solution dispensed from the solution dispenser assembly.

19. The handheld surface cleaning apparatus according to claim 18 wherein the outlet dispensing opening is unvalved.

20. The handheld surface cleaning apparatus according to claim 18 wherein the solution container is configured to comfortably fit the palm of a user's hand and the solution container is formed of a material that is adapted to be squeezed by a user to pressurize the fluid in the solution container and to dispense cleaning fluid from the cleaning fluid container through the foamer and outlet opening onto the surface to be cleaned.

21. The handheld surface cleaning apparatus according to claim 20 and further comprising a brush assembly mounted to the bottom surface of the housing, wherein the brush assembly comprises a plurality of relatively flexible bristles that extend generally perpendicularly from the bottom surface of the housing and the outlet opening is positioned in the bottom surface of the housing within the brush assembly.

* * * * *